US008007132B2

(12) United States Patent
Huang

(10) Patent No.: US 8,007,132 B2
(45) Date of Patent: Aug. 30, 2011

(54) ELECTRIC TORCH

(75) Inventor: Bao-Jun Huang, Shenzhen (CN)

(73) Assignees: Hong Fu Jin Precision Industry (ShenZhen) Co., Ltd., Shenzhen, Guangdong Province (CN); Hon Hai Precision Industry Co., Ltd., Tu-Cheng, New Taipei (TW)

( * ) Notice: Subject to any disclaimer, the term of this patent is extended or adjusted under 35 U.S.C. 154(b) by 366 days.

(21) Appl. No.: 12/428,445

(22) Filed: Apr. 22, 2009

(65) Prior Publication Data

US 2010/0213855 A1 Aug. 26, 2010

(30) Foreign Application Priority Data

Feb. 26, 2009 (CN) ..... 2009 1 0300569

(51) Int. Cl.
*F21V 23/04* (2006.01)
*F21L 4/04* (2006.01)

(52) U.S. Cl. ..... 362/276; 362/186; 362/197; 362/802

(58) Field of Classification Search ..... 362/186, 362/190, 191, 197, 199, 276, 288, 427, 429, 362/802

See application file for complete search history.

(56) References Cited

U.S. PATENT DOCUMENTS

| | | | | | |
|---|---|---|---|---|---|
| 1,665,867 | A * | 4/1928 | Wachtel | ..... | 362/190 |
| 5,541,822 | A * | 7/1996 | Bamber | ..... | 362/190 |
| 5,688,037 | A * | 11/1997 | Chen | ..... | 362/98 |
| 6,780,050 | B1 * | 8/2004 | Wu | ..... | 439/544 |
| 6,789,924 | B2 * | 9/2004 | Yuen | ..... | 362/399 |
| 7,195,371 | B2 * | 3/2007 | Thuma et al. | ..... | 362/199 |
| 7,686,466 | B2 * | 3/2010 | Lev et al. | ..... | 362/23 |

* cited by examiner

*Primary Examiner* — Alan Cariaso

(74) *Attorney, Agent, or Firm* — Altis Law Group, Inc.

(57) ABSTRACT

An electric torch includes a main body, a holder and a connecting portion. The main body includes a lamp shade and a light emitting portion. The lamp shade defines a receiving space. The light emitting portion is secured in the receiving space and configured for emitting light. The holder is rotatably connected to the main body via the connecting portion and configured for supporting the main body. The connecting portion includes a protrusion, a locating rod and a torsion spring. The protrusion is extended from the main body and communicates with the receiving space of the lamp shade. The locating rod is inserted into the protrusion and received in the holder with two ends fixed to the holder. The torsion spring is sleeved on the locating rod with one end attached to the lamp shade and another end attached to the holder.

10 Claims, 5 Drawing Sheets

ELECTRIC TORCH

BACKGROUND

1. Technical Field

The present disclosure relates to torches and, particularly, to an electric torch.

2. Description of Related Art

The flame of a torch can be blown out by wind or extinguished by rain. Recently, electric torches are being used for windy or rainy days. However, such electric torches usually have very complex structure which increase the cost of the electric torches.

What is needed, therefore, is an electric torch with simple structure to overcome the above-described problem.

BRIEF DESCRIPTION OF THE DRAWINGS

Many aspects of the present electric torch can be better understood with references to the accompanying drawings. The components in the drawing are not necessarily drawn to scale, the emphasis instead being placed upon clearly illustrating the principles of the present electric torch.

DETAILED DESCRIPTION

Embodiments of the present disclosure will now be described in detail below, with references to the accompanying drawings.

Figure 1:
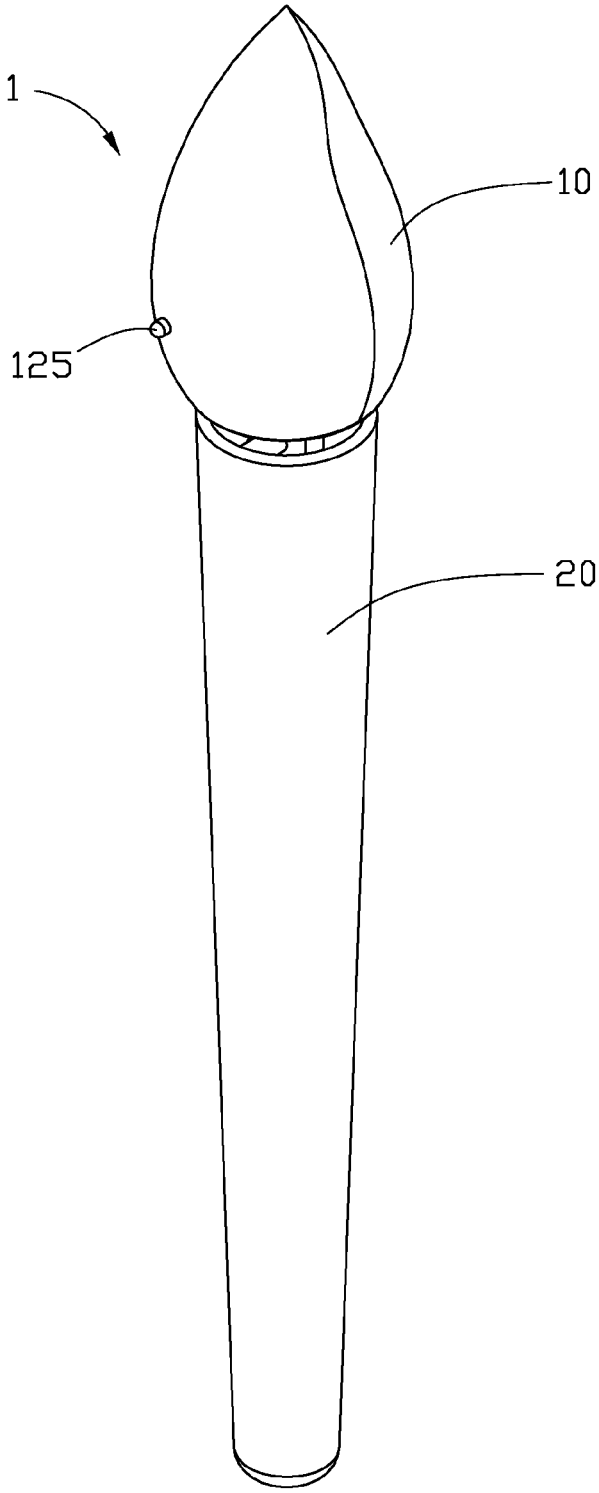
FIG. 1 is an isometric, assembled view of an electric torch according to an exemplary embodiment.
Figure 3:
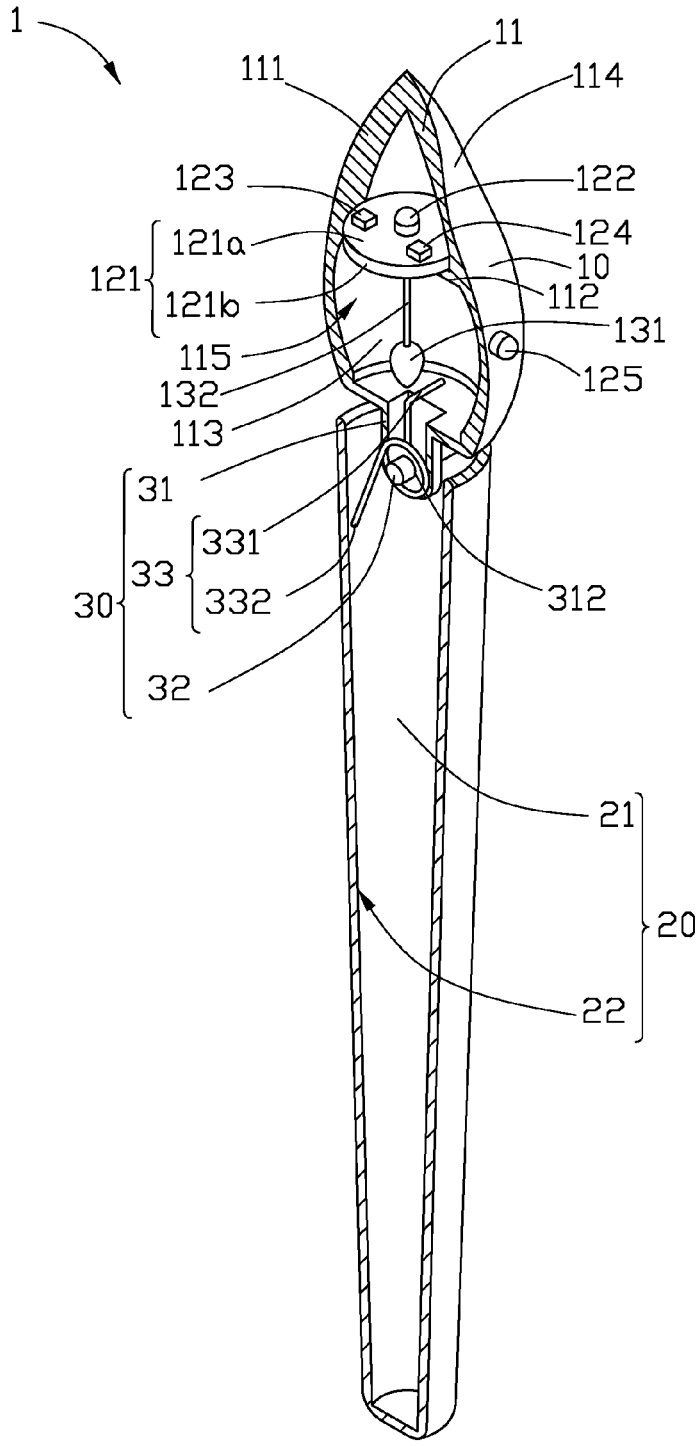
FIG. 3 is a cut-away view of the electric torch of FIG. 1.

Referring to FIG. 1 and FIG. 3, an electric torch 1 according to an exemplary embodiment is shown. The electric torch 1 includes a main body 10, a holder 20 and a connecting portion 30 connecting the main body 10 and the holder 20.

Figure 2:
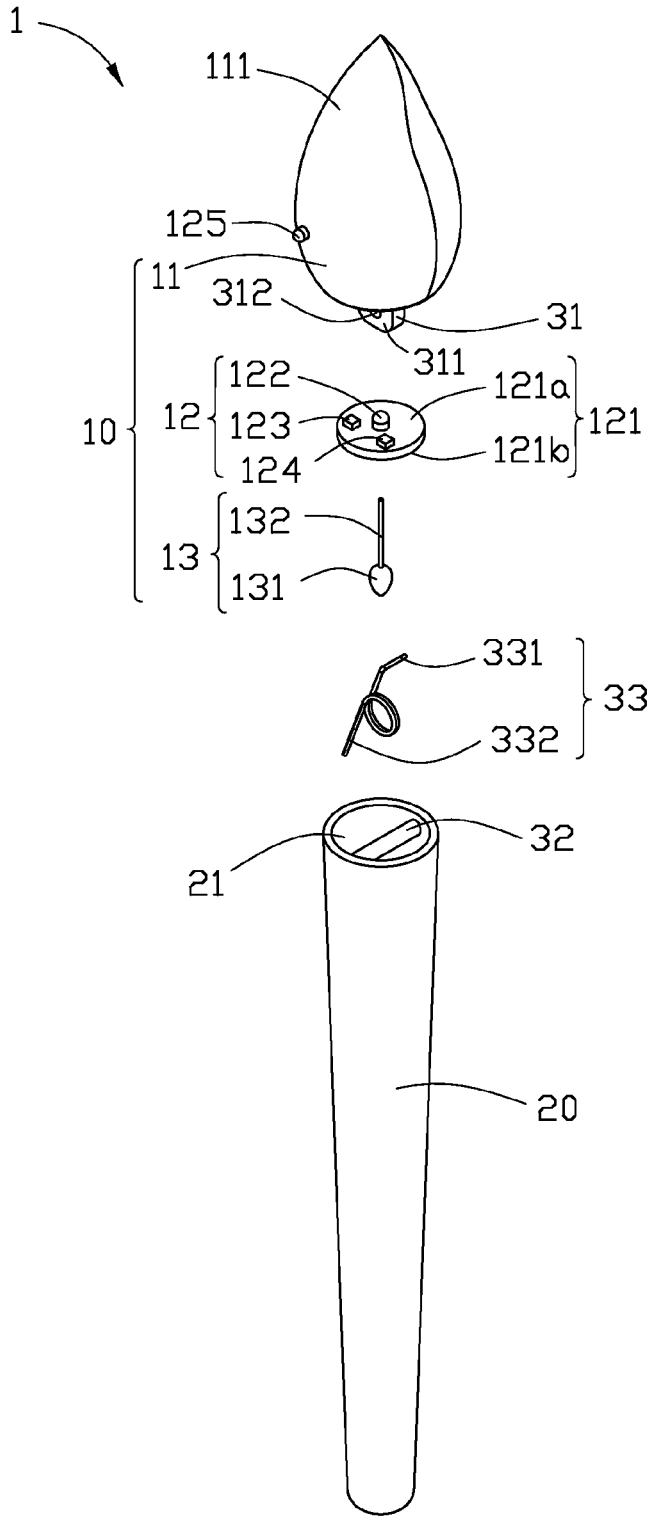
FIG. 2 is an isometric, exploded view of the electric torch of FIG. 1.

Further referring to FIG. 2, the main body 10 includes a lamp shade 11, a light emitting portion 12, and a plumb 13.

The shape of the lamp shade 11 is flame shaped. The lamp shade 11 includes a casing 111 and a supporting plate 112. The casing 111 defines a receiving space 113 therein. The casing 111 includes an external surface 114 and an internal surface 115. The supporting plate 112 is received in the receiving space 113 and fixed to the internal surface 115 of the casing 111 for supporting the light emitting portion 12 and defines a central through hole 116 (see FIG. 5).

The light emitting portion 12 includes a loading plate 121, a lamp 122, a light sensing element 123, a battery 124, and a switch 125. The loading plate 121 is secured on the supporting plate 112. The loading plate 121 includes a top surface 121*a* and a bottom surface 121*b* opposite to the top surface 121*a*. The lamp 122, the light sensing element 123, and the battery 124 are secured on the top surface 121*a* of the loading plate 121. In the present embodiment, the switch 125 is secured on the external surface 114 of the lamp shade 11. It is understood that, in other embodiments, the switch 125 can also be arranged at other places, such as on the holder 20.

Figure 4:
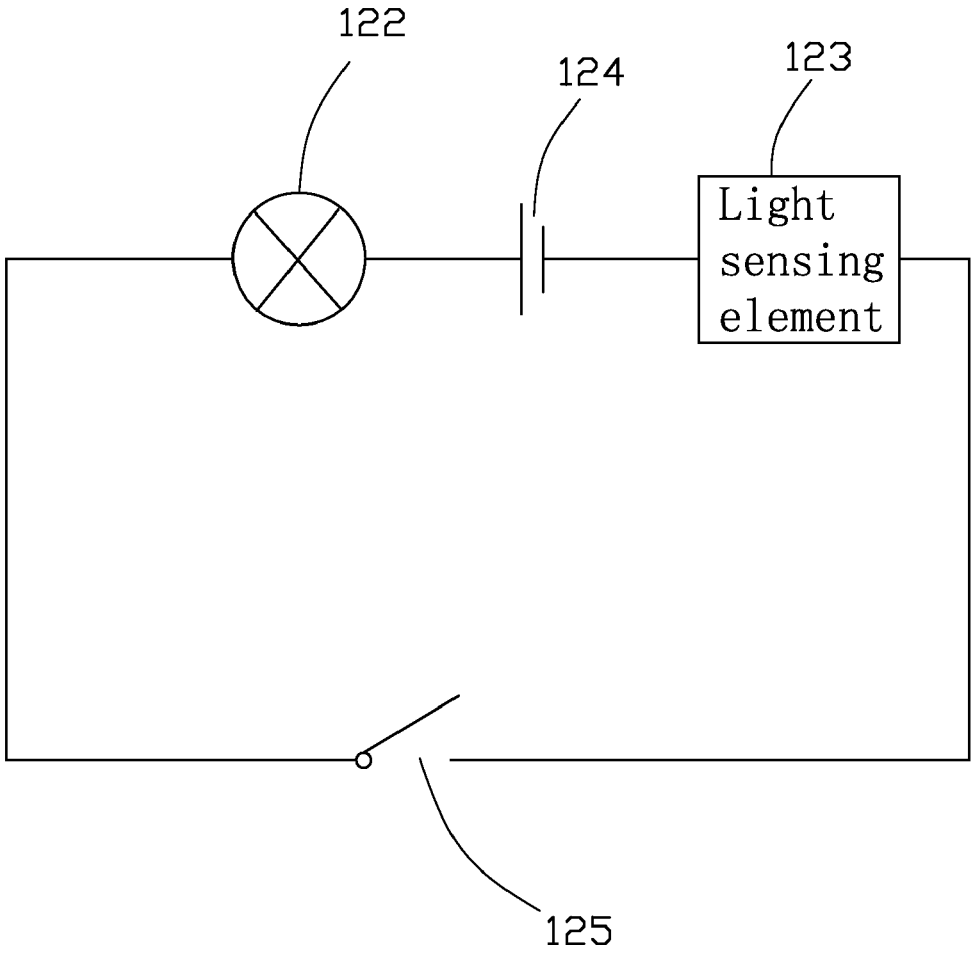
FIG. 4 is a circuit diagram of the electric torch of FIG. 1.

Further referring to FIG. 4, the lamp 122, the switch 125, and the light sensing element 123 are electrically connected in series from the anode of the battery 124 to the cathode of the battery 124. The battery 124 is used for providing power to the lamp 122. The light sensing element 123 can sense the ambient brightness and control the lamp 122 to turn on or off accordingly. In the present embodiment, the light sensing element 123 is a photovaristor that becomes electrically conductive when the ambient brightness is above a predetermined value. The lamp 122 is a light-emitting diode.

Referring to FIGS. 2-3, the plumb 13 includes a plumb bob 131 and a plumb line 132. The plumb bob 131 is connected to the bottom surface 121*b* of the loading plate 121 via the plumb line 132 through the central through hole 116 (see FIG. 5) of the supporting plate 112. The plumb bob 131 is configured to be much heavier than the lamp shade 11, therefore, the plumb bob 131 can swing relative to the loading plate 121 and control the center of gravity of the main body 10.

The holder 20 is rotatably connected to the main body 10 via the connecting portion 30. In the present embodiment, the holder 20 is suspendably connected to the main body 10. The holder 20 defines a cavity 21 surrounded by an inner surface 22 of the holder 20.

The connecting portion 30 includes a protrusion 31, a locating rod 32, and a torsion spring 33. The protrusion 31 is extended from the main body 10. The protrusion 31 is hollow and communicates with the receiving space 113 of the lamp shade 11. The protrusion 31 includes two side walls 311 (see FIG. 2) and defines a through hole 312 (see FIG. 3) running through the two sidewalls 311. The locating rod 32 is inserted into the through hole 312 and is received in the cavity 21 with two ends fixed to the inner surface 22 of the holder 20. The torsion spring 33 is sleeved on the locating rod 32 and is received in the protrusion 31. The torsion spring 33 includes a first end 331 and a second end 332 opposite to the first end 331. The first end 331 is attached to the internal surface 115 of the lamp shade 11. The second end 332 is extended from the protrusion 31 to attach to the inner surface 22 of the holder 20.

Figure 5:
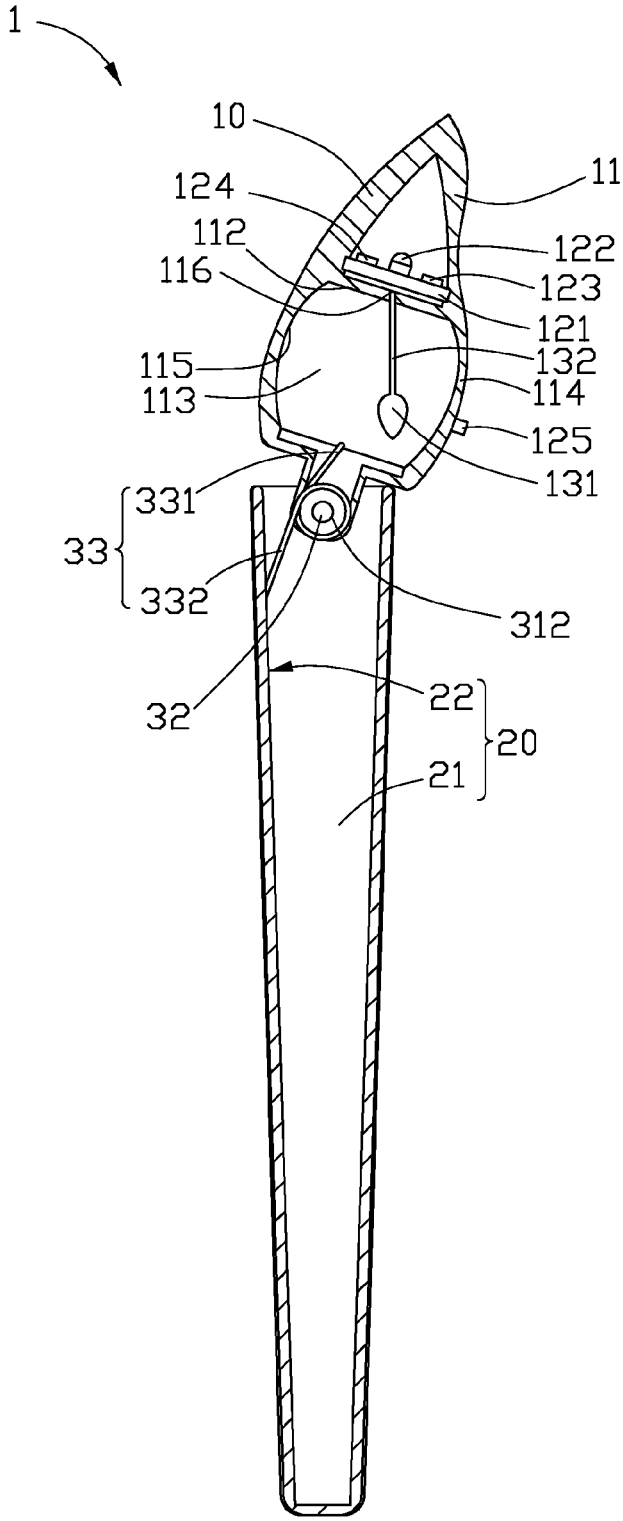
FIG. 5 is a cut-away view of the electric torch of FIG. 1 in a working statement.

Further referring to FIG. 5, when the electric torch 1 is used, the switch 125 is turned on and when the ambient brightness is above a predetermined value, the light sensing element 123 is electrically conductive and the lamp 122 will emit light. When the electric torch 1 moves in a forward motion, the lamp shade 11 will tilt backwards. Therefore, the lamp shade 11 will appear like a real flame. In the present embodiment, because the plumb bob 131 is configured to be heavier than the lamp shade 11 and always remains vertical, the lamp shade 11 can swing in a bigger span. It is understood that, in other embodiments, the plumb 13 also can be omitted.

While certain embodiments have been described and exemplified above, various other embodiments will be apparent to those skilled in the art from the foregoing disclosure. The present invention is not limited to the particular embodiments described and exemplified, and the embodiments are capable of considerable variation and modification without departure from the scope of the appended claims.

What is claimed is:

1. An electric torch comprising:

a main body comprising a lamp shade and a light emitting portion, the lamp shade defining a receiving space, the light emitting portion secured in the receiving space and configured for emitting light; and a holder rotatably connected to the main body via a connecting portion and configured for supporting the main body;

the connecting portion comprising:

a protrusion extended from the main body and communicated with the receiving space of the lamp shade;

a locating rod running through the protrusion and received in the holder with two ends fixed to the holder; and a torsion spring sleeved on the locating rod, with one end attached to the lamp shade and another end attached to the holder.

2. The electric torch as claimed in claim 1, wherein the light emitting portion comprises a lamp, a battery and a switch electrically connected in series from an anode of the battery to a cathode of the battery.

3. The electric torch as claimed in claim 2, wherein the switch is secured on the lamp shade.

4. The electric torch as claimed in claim 2, wherein the switch is secured on the holder.

5. The electric torch as claimed in claim 2, wherein the light emitting portion further comprises a light sensing element electrically connected to the lamp, the battery, and the switch in series, and the light sensing element is configured for sensing the ambient brightness and controlling the lamp to turn on or off accordingly.

6. The electric torch as claimed in claim 2, wherein the lamp shade further comprises a supporting plate received in the receiving space and fixed to the lamp shade.

7. The electric torch as claimed in claim 6, wherein the light emitting portion further comprises a loading plate secured on the supporting plate, the loading plate comprises a top surface and a bottom surface opposite to the top surface, and the lamp and the battery are secured on the top surface of the loading plate.

8. The electric torch as claimed in claim 7, wherein the main body comprises a plumb bob connected to the bottom surface via a plumb line.

9. The electric torch as claimed in claim 8, wherein the plumb is configured to be heavier than the lamp shade.

10. The electric torch as claimed in claim 2, wherein the lamp is a light-emitting diode.

* * * * *